US007845264B2

(12) United States Patent
Van Dyke-Restifo et al.

(10) Patent No.: US 7,845,264 B2
(45) Date of Patent: Dec. 7, 2010

(54) AUTOMATIC PRIMER FEED MECHANISM

(75) Inventors: Stephen M. Van Dyke-Restifo, Voorheesville, NY (US); Lisa J. Madigan, Melrose, NY (US); Douglas F. Olcott, Germantown, MD (US); Dominick Scalise, Herkimer, NY (US); Ralph P. Mischitelli, Albany, NY (US); Robert J. Mysliwiec, East Greenbush, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 564 days.

(21) Appl. No.: 11/743,909

(22) Filed: May 3, 2007

(65) Prior Publication Data

US 2010/0282059 A1 Nov. 11, 2010

Related U.S. Application Data

(63) Continuation of application No. 10/907,911, filed on Apr. 20, 2005, now Pat. No. 7,246,549, which is a continuation-in-part of application No. 10/501,620, filed on Jun. 8, 2004, now Pat. No. 7,228,779.

(51) Int. Cl.
*F41A 19/13* (2006.01)

(52) U.S. Cl. ..... 89/27.13

(58) Field of Classification Search ..... 42/87; 89/27.13

See application file for complete search history.

(56) References Cited

U.S. PATENT DOCUMENTS 1,797,951 A * 3/1931 Gaidos ..... 42/50
4,862,620 A * 9/1989 Chesnut et al. ..... 42/50
5,375,359 A * 12/1994 Chesnut et al. ..... 42/50

* cited by examiner

*Primary Examiner*—Stephen M Johnson
(74) *Attorney, Agent, or Firm*—John F. Moran

(57) ABSTRACT

A primer feed mechanism mounted on a carrier of an artillery piece includes a body assembly for mounting the primer feed mechanism on the carrier, the body assembly having guide rails and a follower plate; a tray assembly that is movable on the guide rails of the body assembly, the tray assembly including a housing and an injector arm assembly; an actuator drive link connected to the carrier; a quick release link connected to the actuator drive link; and a drive link assembly connected to the quick release link and to the injector arm assembly; wherein one end of the injector arm assembly includes a push pin that reciprocates in the housing to inject a primer and another end of the injector arm assembly includes a follower that travels in the follower plate of the body assembly.

4 Claims, 21 Drawing Sheets

AUTOMATIC PRIMER FEED MECHANISM

CROSS REFERENCE TO RELATED APPLICATIONS

This application is a continuation of application Ser. No. 10/907,911 filed Apr. 20, 2005, now U.S. Pat. No. 7,246,549, which application is a continuation-in-part of U.S. patent application Ser. No. 10/501,620 having a U.S. filing date of Jun. 8, 2004 now U.S. Pat. No. 7,228,779 and an international filing date of Aug. 13, 2001 (PCT/US01/25605) and entitled "Automatic Primer Feed Mechanism", which application is hereby incorporated by reference. This application claims the benefit of priority of international application number PCT/US01/25605 having an international filing date of Aug. 13, 2001, which claims the benefit of priority of U.S. provisional application Ser. No. 60/230,450 filed on Sep. 6, 2000 and U.S. nonprovisional application Ser. No. 09/718,106 filed on Nov. 15, 2000. This application expressly incorporates by reference all prior filed applications set forth above.

STATEMENT OF GOVERNMENT INTEREST

The invention described herein may be manufactured and used by or for the United States Government for Governmental purposes without the payment of any royalties thereon.

BACKGROUND OF THE INVENTION

1. Field of the Invention

This invention relates generally to artillery and, more particularly, to a mechanism for automatically feeding primer cartridges in an artillery piece.

2. Description of the Prior Art

Field artillery pieces operate by detonating a propellant charge behind a projectile in a gun barrel. Typically the propellant charge is detonated by means of a primer cartridge that, in turn, is detonated by the force of an externally applied blow or electrical current. A fresh (unfired) primer cartridge must be used for each firing of the artillery piece.

More responsive and effective artillery fire requires a faster rate of fire and reduced labor intensiveness. Presently, for large caliber artillery pieces with interrupted screw block breech mechanisms such as 155-mm artillery pieces and the like, percussion primers are loaded by hand or using various types of automatic feed mechanisms. In manual loading, one primer is manually placed in the spindle primer chamber and the firing mechanism is then manually moved over the primer in the ready-to-fire position. The manual technique is subject to human errors, injury and problems inserting the primer, especially when the light is dim.

Until the present invention, there have not been effective fail-safe alternatives to manual loading of primers. There is a need for a primer feed mechanism that automatically feeds live primers and ejects spent primer cases in large caliber artillery pieces (for example, a 155-mm gun). Carroll et al. teach one known automatic-type primer feed mechanism in U.S. Statutory Invention Registration H-1121, which is hereby incorporated by reference. One problem with the Carroll et al. mechanism is accidental misfiring of a primer cartridge before proper closing of the breech, which may result in human injury or death. Thus, there is a need for a safe and efficient system for loading primer cartridges in the breech of a gun.

SUMMARY OF THE INVENTION

It is an object of the invention to provide a new and improved device for feeding primer cartridges in an artillery piece. The device loads a fresh primer after full breech closure and extracts a spent primer before breech opening to maximize safety. Thus, the gun crew can safely perform gun misfire, sticker and check fire operations before the breech is opened.

It is another object of the invention to provide a new and improved device for feeding primer cartridges in an artillery piece, wherein the primer cartridges are automatically fed with a minimum of handling by operating personnel, thereby shortening the length of the fire cycle.

It is a further object of the invention to provide a new and improved device for feeding primers in an artillery piece that is reliable and able to withstand the repeated recoil of the artillery piece as it is fired over and over.

Yet another object of the invention is to provide a device for automatically feeding primers, which reduces the number of gun crewmembers required.

Still another object of the invention is to provide a device for automatically feeding primer cartridges to large artillery pieces, which is safe, dependable, and easy to maintain.

The invention includes a body assembly for mounting the primer feed mechanism to the carrier of the artillery piece to position the primer feed mechanism on one side of the breech of the artillery piece. The body assembly includes a follower plate for motion control of a primer injector arm assembly. The body assembly has guides that control movements of and retain a tray assembly. The tray assembly includes congruent guide rails for engagement with the body assembly's guides. The body assembly includes a primer extractor for extracting spent primers when the tray assembly is moved to an extraction position. Movement of the tray assembly is controlled by cooperative action with the primer injector arm assembly that is attached through linkages to an actuator attached to the carrier.

The invention includes a primer cartridge magazine assembly mounted in the tray assembly for housing a plurality of primers for insertion into the artillery piece. The primer cartridge magazine assembly includes a slot in one side to permit the pushpin of the injector arm assembly to cooperatively engage and move primers contained in the magazine assembly upon movement of the injector arm assembly to a ready-to-fire-position. The tray assembly includes an integral receiver for mounting the magazine. Live primer cartridges are stored in the magazine assembly that is attached to the tray assembly. The tray assembly in turn is attached to the body assembly and located at a safe distance from the primer chamber within the spindle, thereby preventing flames from reaching the charge and igniting prematurely.

During a fire cycle of operation, recoil motion of the artillery piece disconnects the primer feed mechanism from external actuator drive linkages while the tray assembly remains locked in a fire position during recoil and counter recoil. An external drive linkage of the primer feed mechanism re-engages the system mounted drive actuator on counter-recoil. The extract cycle of a spent primer cartridge is initiated after counter recoil and the extract cycle is completed prior to the breech of the artillery piece being opened. The primer feed mechanism can be manually, hydraulically, or otherwise power actuated from the fire position to the extract position of the mechanism.

The operation of the primer feed mechanism includes: a) locking the tray assembly in an extract position using a safety latch assembly and opening the breech; b) loading a charge and projectile; c) closing the breech fully, which releases the safety latch assembly; d) actuating the injector arm assembly to cause the tray assembly to translate from the extract to the fire position; e) dwelling the tray assembly's linear motion as the injector arm assembly rotates to inject a fresh primer; f) resuming linear motion of the tray assembly with the injector arm assembly in a down position, the tray assembly moving to the fire position; and g) locking the tray assembly in the fire position by a locking plunger moving into a locking plunger pocket in the body assembly.

The primer feed mechanism of the invention offers several advantages. For example, loading is simplified because the gun crew need only handle previously loaded magazine assemblies rather than individual primers. The primer feed mechanism improves safety because live primers stored in a magazine assembly are at a safe distance from the primer chamber, thereby preventing flame from reaching a live charge. A fresh primer is loaded after full breech closure and extracted before the breech is opened, thereby allowing the gun crew to perform misfire, sticker, and check fire operations before the breech is opened.

The invention will be better understood, and further objects, features and advantages of the invention will become apparent from the following detailed description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

FIGS. 3*a*, 3*a*-2 and 3*a*-3 are perspective views of the tray assembly.

FIG. 3*a*-1 is an exploded view of the tray assembly.

FIGS. 3*b* and 3*b*-1 are perspective views of the injector arm assembly.

FIG. 3*c* is a perspective view and FIG. 3*c*-1 is an exploded view of the body assembly.

FIG. 3*e*-1 is an exploded view and FIG. 3*e*-2 is a perspective view of the pusher assembly contained in the magazine assembly.

DETAILED DESCRIPTION OF THE PREFERRED EMBODIMENTS

Figure 1:
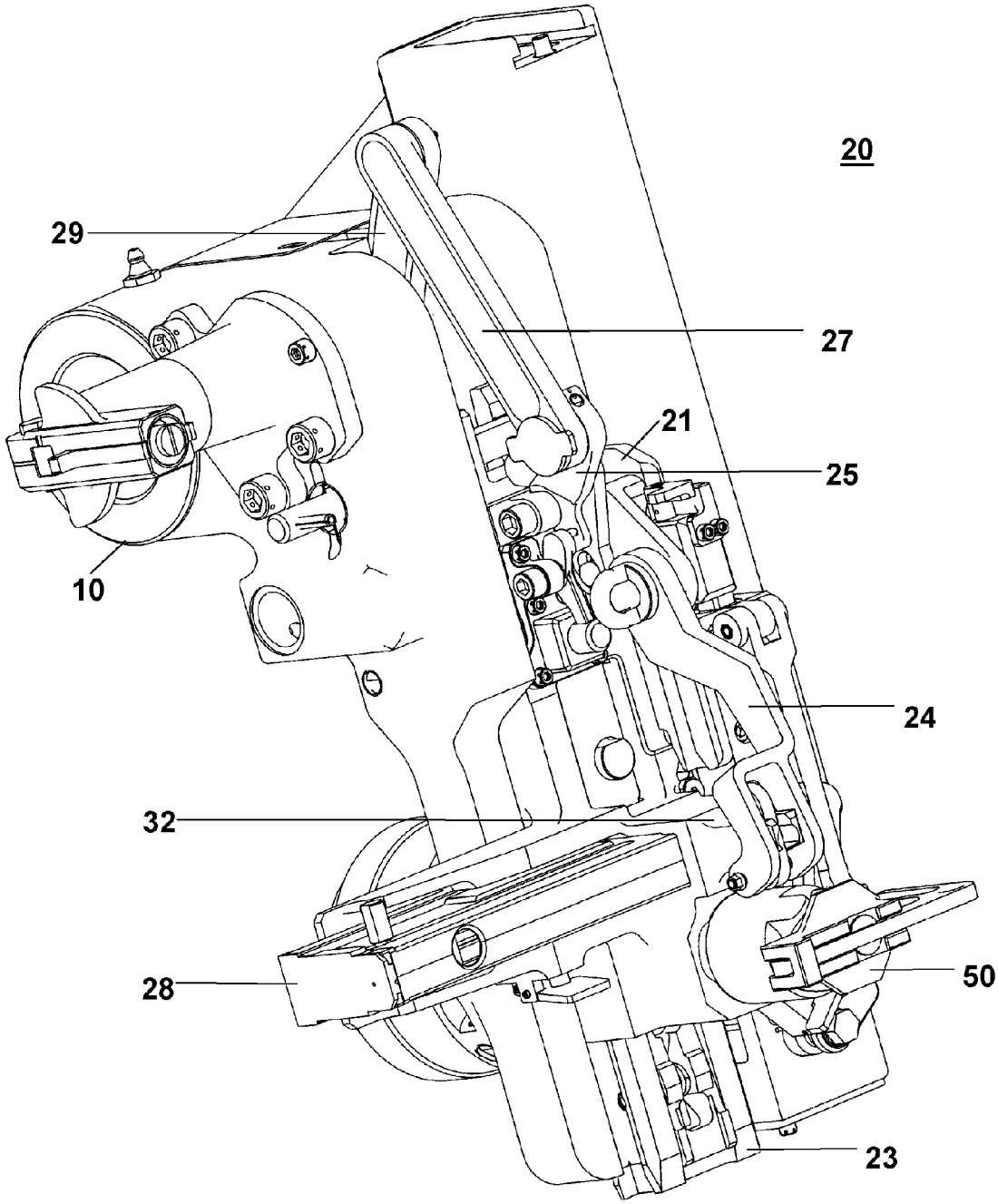
FIG. 1 is a perspective view of a primer feed mechanism in the fire position.

Referring to the drawings, and, in particular, to FIGS. 1-5, a primer feed mechanism 20 is shown mounted adjacent to the breech carrier end of an artillery piece. In accordance with conventional practice, the artillery piece includes a breech block (not shown for clarity) mounted to a hinged breech carrier 10 that swings to allow the breech to be opened and closed. The breech block's interior face includes an obturator that is carried at one end of a spindle extending through the breech block. The obturator and obturator spindle 8 include a central passageway 9 that terminates at one end in a chamber 4 for receiving therein a primer cartridge 26 of known construction. In use (FIGS. 5-12), a propellant charge is placed in the gun barrel ahead of the breech block which is then closed. Detonation of the primer cartridge 26 ignites the propellant charge through the passageway 9 to fire the artillery piece.

In general, the primer feed mechanism 20 functions to contain a plurality of primers 26, to automatically insert an unfired primer into the chamber 4 and to automatically extract a fired primer from the chamber in a safe manner so that the breech closes prior to insertion of the next primer. To this end, the primer feed mechanism 20 includes a magazine assembly 28 for containing a plurality of primer cartridges 26, a receiving area 45 formed in a tray assembly 21 for mounting the magazine assembly 28 to the feed mechanism 20, and a firing mechanism assembly 50 retained in a firing mechanism pocket 51. Firing mechanism assembly 50 is responsive to an operator input for firing the artillery piece. Preferably, the magazine assembly 28 is a detachable unit to permit substitution of a magazine assembly containing fresh primers.

The primer feed mechanism 20 is designed for use with the carrier 10 of a large caliber artillery piece (in exemplary form, a 155-mm howitzer). A rack (not shown) is inserted in the hinged carrier 10 that swings to allow opening and closing of the breech. The primer feed mechanism 20 includes a body assembly 23 and a tray assembly 21. Body assembly 23 includes a follower plate 22 and tray assembly 21 includes a follower 31. Follower 31 travels in follower plate 22. An actuator drive link 29 connects with the carrier 10 which in turn has an actuator (not shown) attached to the carrier. Quick release link 27 connects at one end to actuator drive link 29 and at another end to drive link assembly 25. Drive link assembly 25 connects with an injector arm assembly 24.

The carrier actuator (not shown) causes the actuator drive link 29 to move which in turn moves the quick release link 27. Quick release link 27 moves the drive link assembly 25 and follower 31. Drive link assembly 25 moves the injector arm assembly 24. FIGS. 3*b* and 3*b*-1 are perspective views of the injector arm assembly 24. One end of the injector arm assembly 24 travels in the follower plate 22 via the follower 31. The other end of the injector arm assembly 24 includes a push pin 24*a* that reciprocates in a housing 32 forming part of the tray assembly 21. One end of the push pin 24*a* has a slot 33 that receives connecting rod 35 of the injector arm assembly 24 (FIGS. 3*b* and 3*b*-1). Connecting rod 35 passes through bushings 35*a*. This feature prevents jamming of the push pin 24*a* in housing 32 as the primer is injected and also minimizes misfiring of a primer during the injection operation. The other end of the push pin 24*a* has a hollow surface for engaging the primer outside of the central percussion area of the primer.

The primer feed mechanism 20 is attached to the carrier 10 through the body assembly 23. FIG. 3*c* is a perspective view and FIG. 3*c*-1 is an exploded view of the body assembly 23. The tray assembly 21 slides on guide rail 42 of the body assembly 23. The body assembly 23 includes a primer extractor 102 that is actuated by an extract member 12 of the tray assembly 21. The primer extractor 102 ejects spent primers during the eject cycle of operation of the primer feed mechanism. The magazine assembly 28 also inserts and slides within a receiver area 45 in the tray assembly 21. Body assembly 23 (FIG. 3*c*-1) further includes a body 64, a locking plunger 60, compression spring 61, cross pin 62 and cap screws 63 that secure the follower plate 22 to the body 64. Primer extractor 102 connects to body 64 via spring pin 99 and extractor shaft 100. Primer extractor 102 includes a torsion spring 101.

Figure 2:
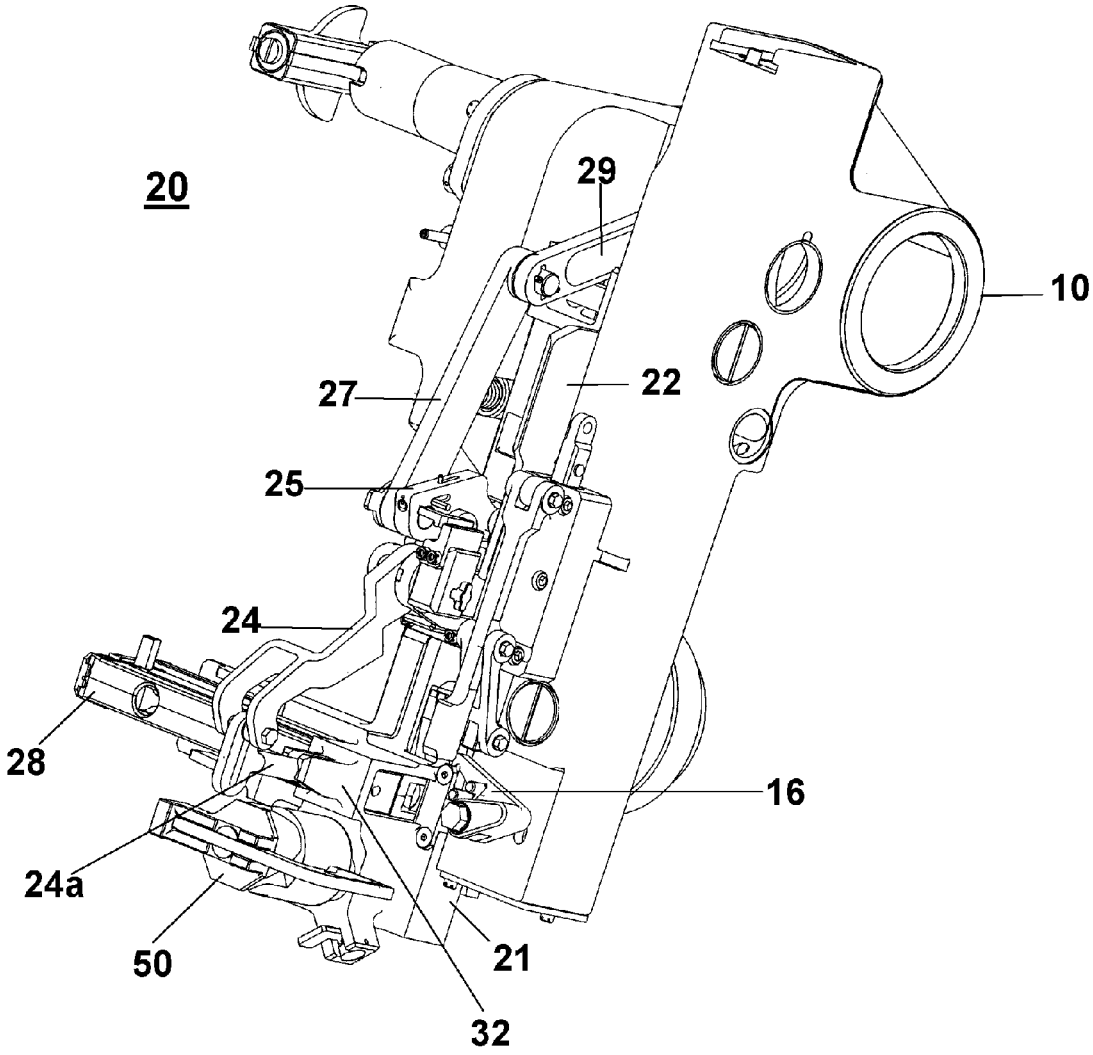
FIG. 2 is another perspective view of the primer feed mechanism of FIG. 1 in the extract position.
Figure 3A:
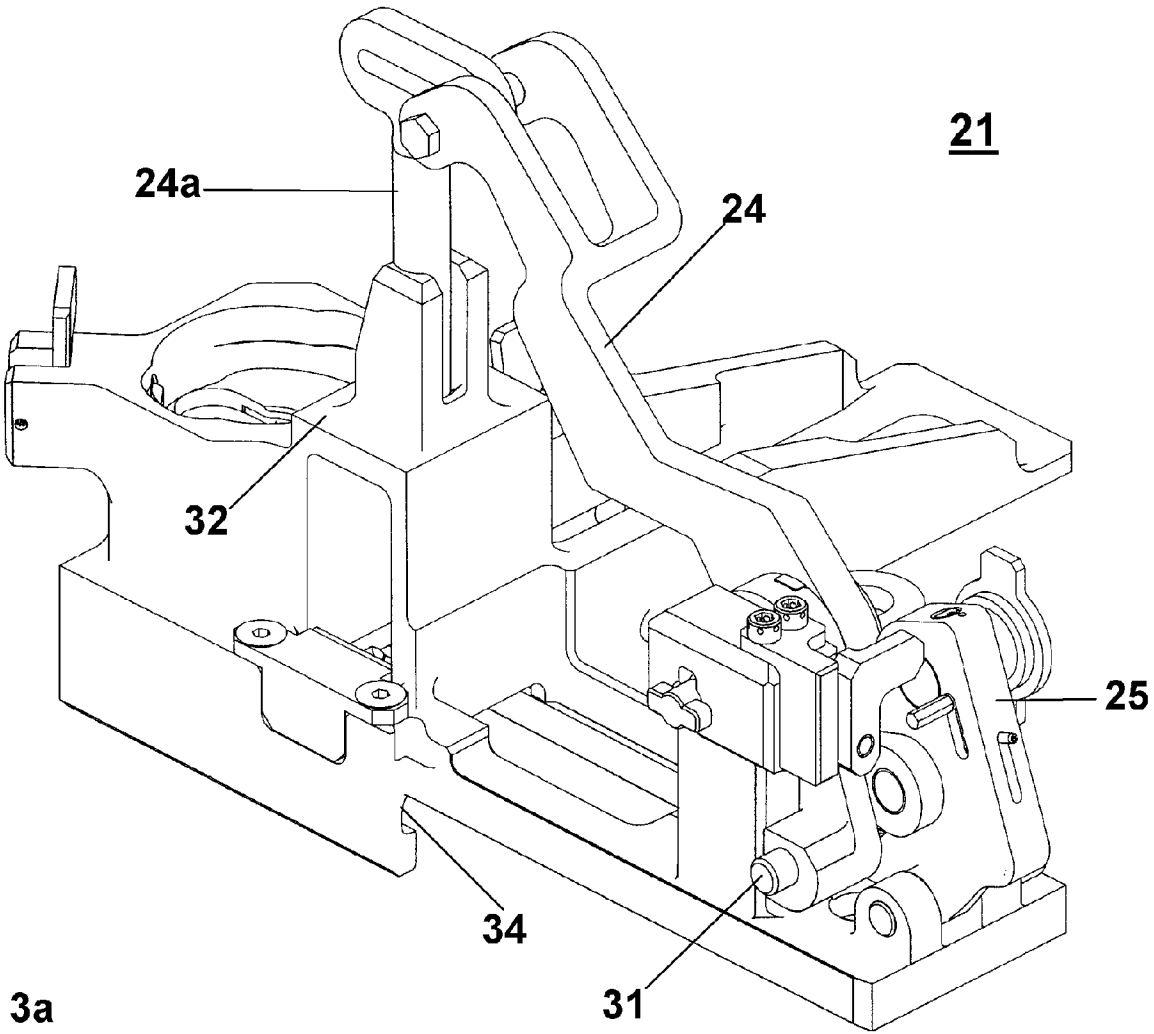
Figures 1, 3A:
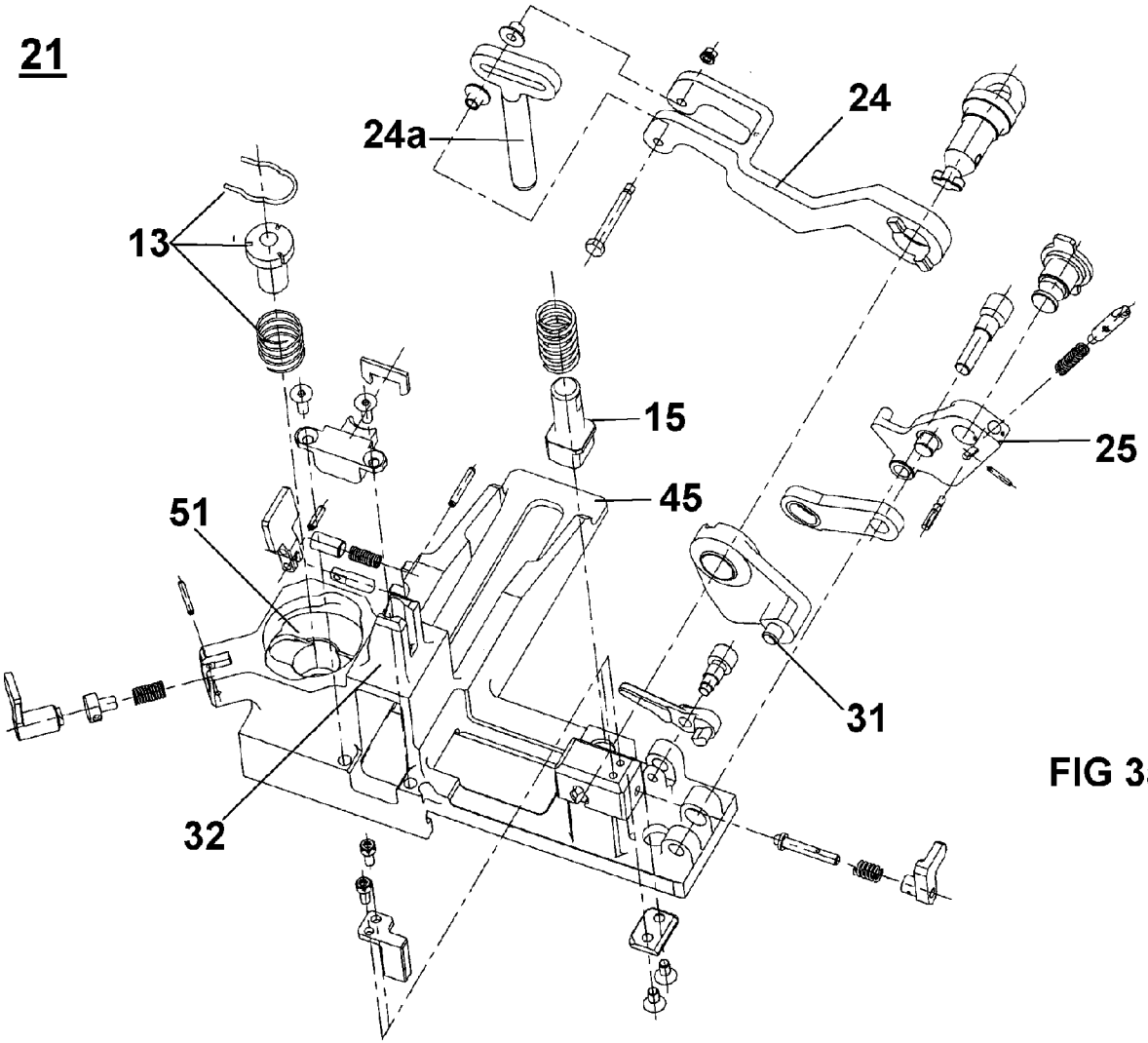
Figures 2, 3A:
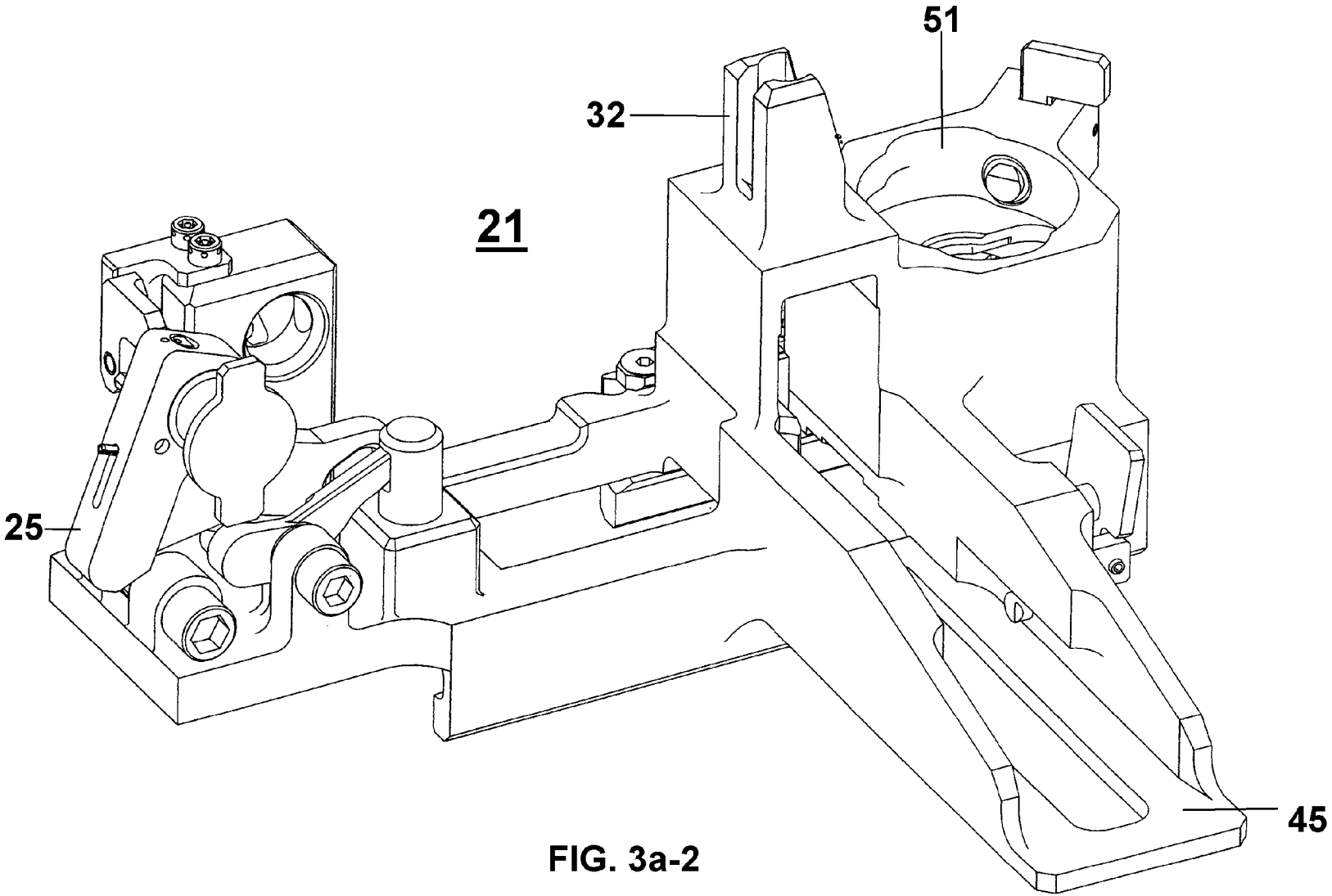
Figures 3, 3A:
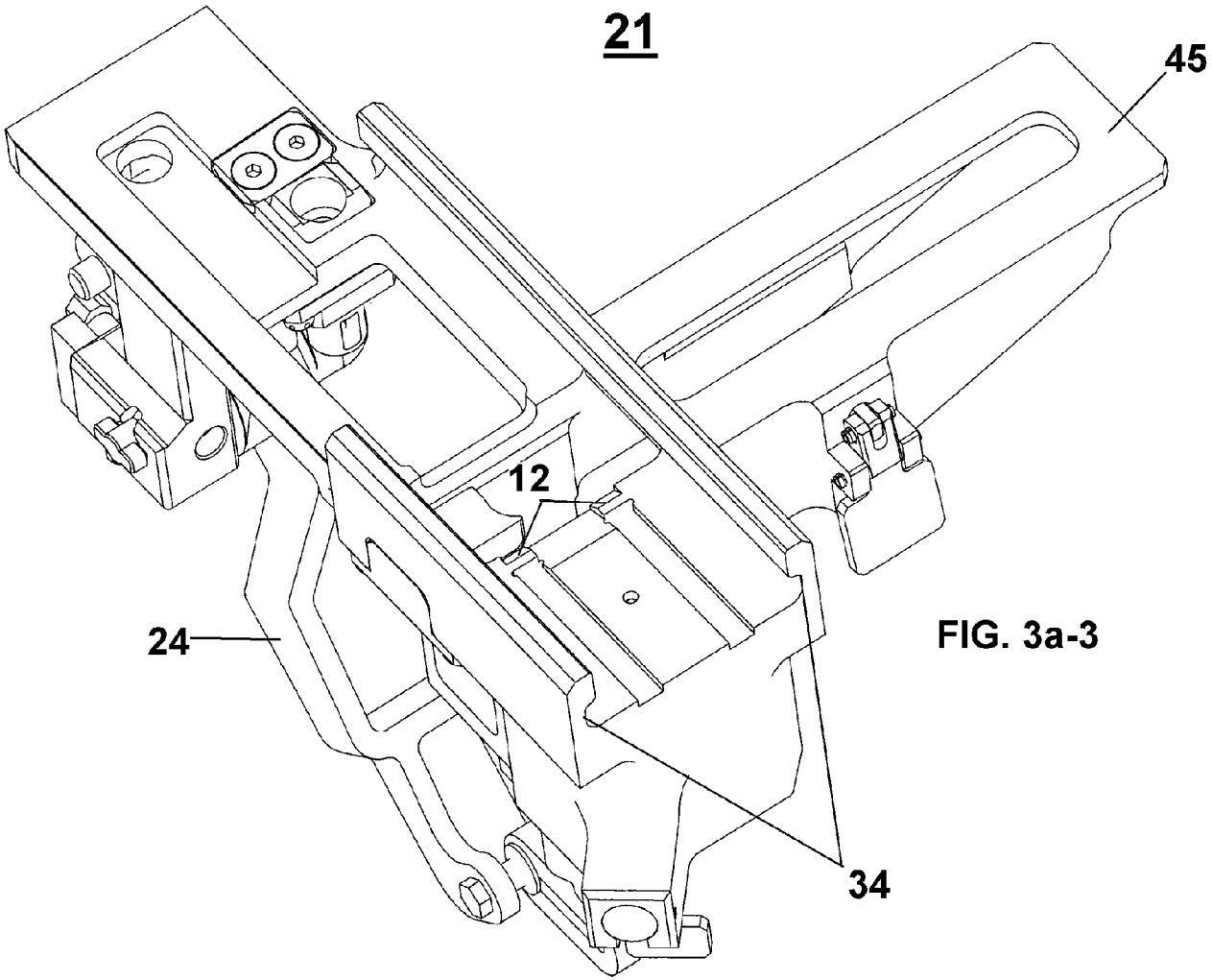
Figures 1, 3B:
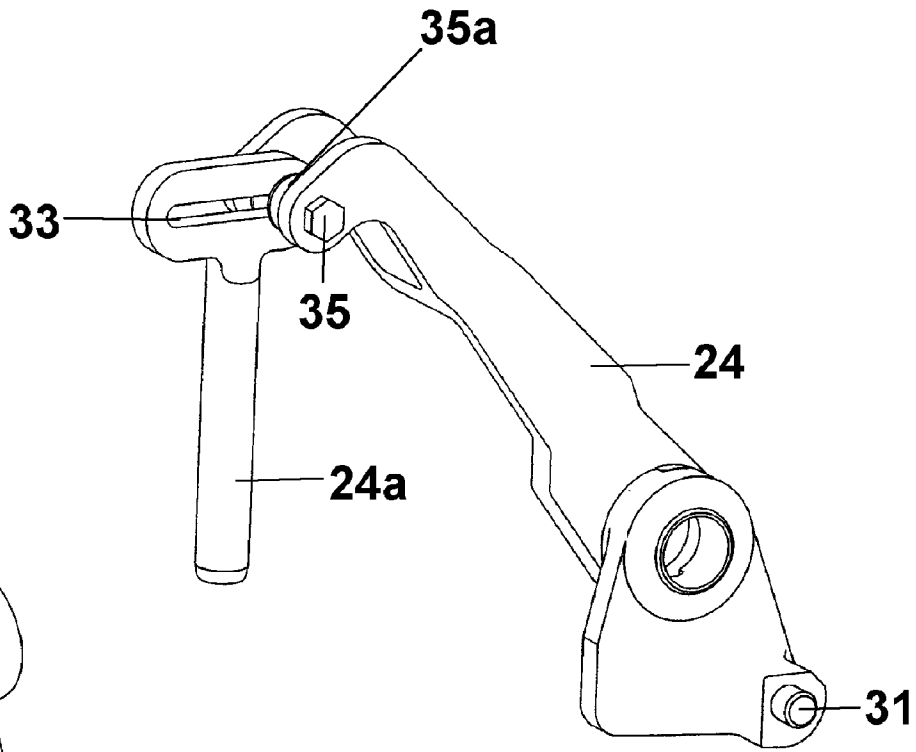
Figure 3B:
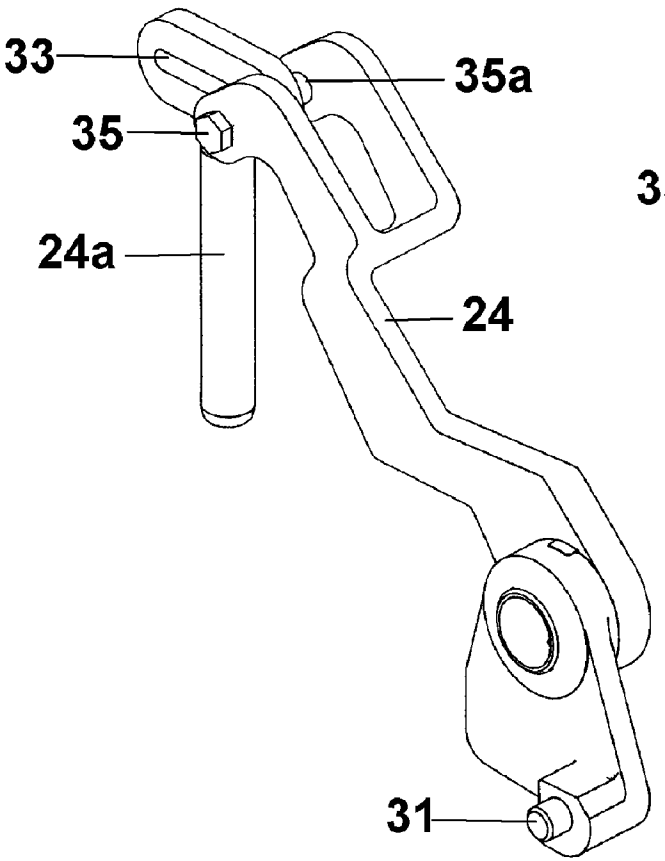
Figures 1, 3C:
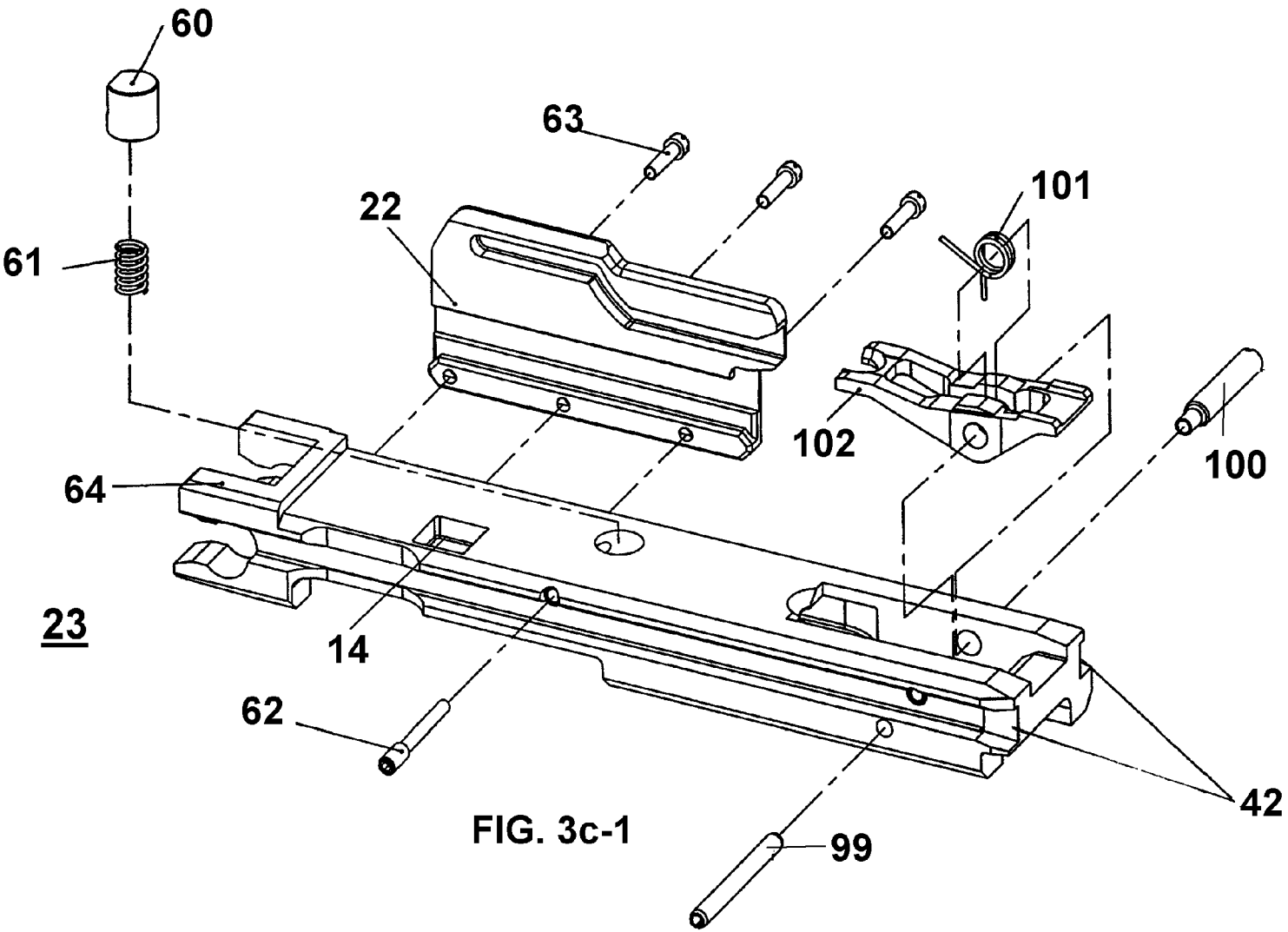
Figure 3C:
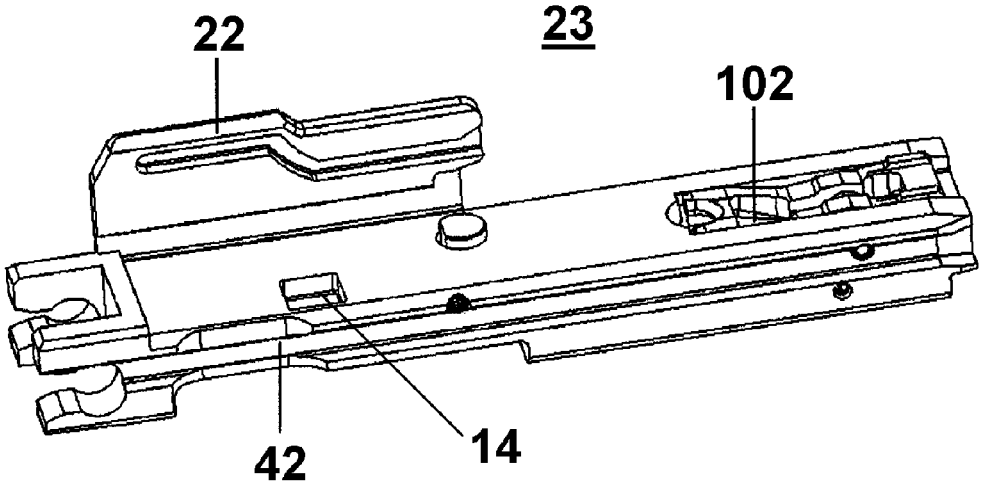

FIGS. 3*a*, 3*a*-2 and 3*a*-3 are perspective views of the tray assembly 21. FIG. 3*a*-1 is an exploded view of the tray assembly 21. The tray assembly 21 fits onto the body assembly 23 along the tray assembly guide 34 shown in FIG. 3*a*. Follower 31, which attaches to the injector arm assembly 24, follows the follower plate path of the follower plate 22 located on the body assembly 23. Movement of follower 31 causes movement of the injector arm assembly 24 and tray assembly 21. As seen in FIGS. 1 and 2, one end of the tray assembly 21 includes a firing mechanism assembly 50 with a firing pin assembly 13 (FIG. 3*a*-1) located under the firing mechanism assembly 50. The firing mechanism assembly 50 is typically a spring-loaded mechanical firing mechanism that is detachable and inserted in the firing mechanism pocket 51 in the tray assembly 21.

Figure 3D:
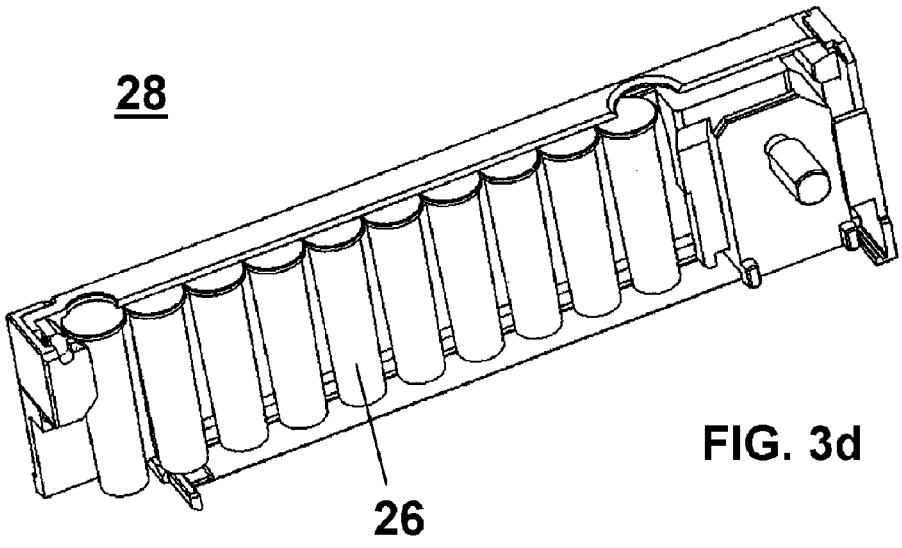
FIG. 3*d* is a perspective view (top half removed) and FIG. 3*e* is an exploded view of the magazine assembly.
Figure 3E:
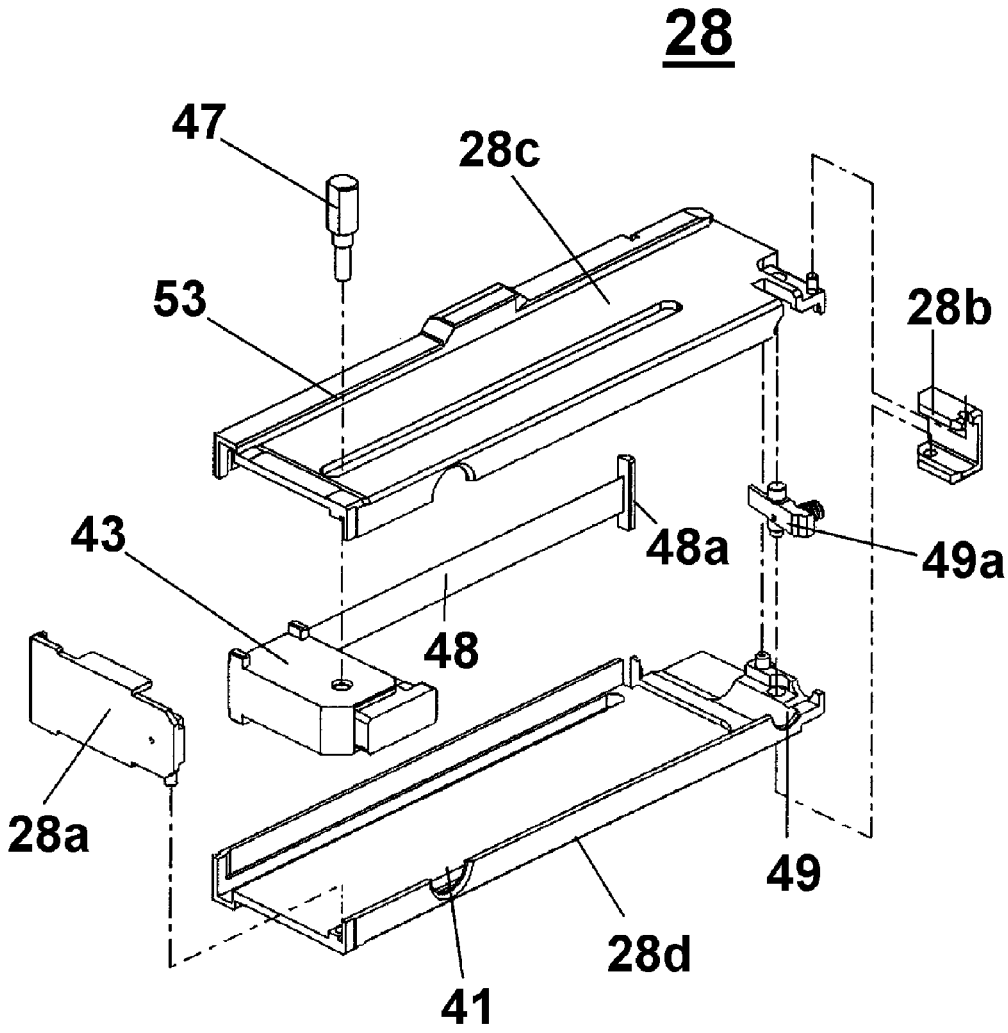
Figures 2, 3E:
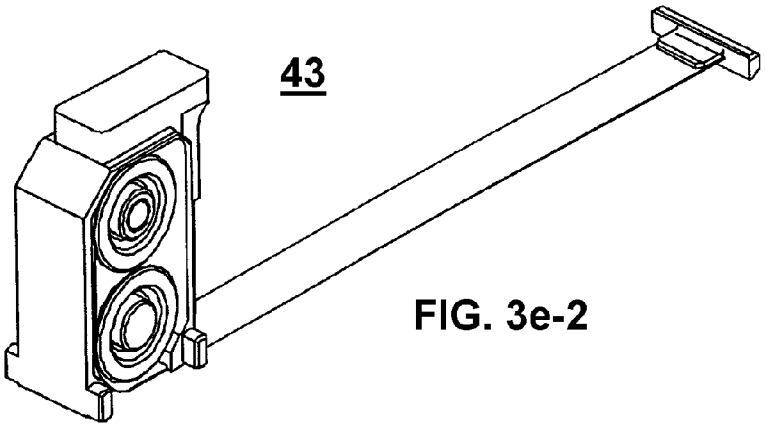
Figures 1, 3E:
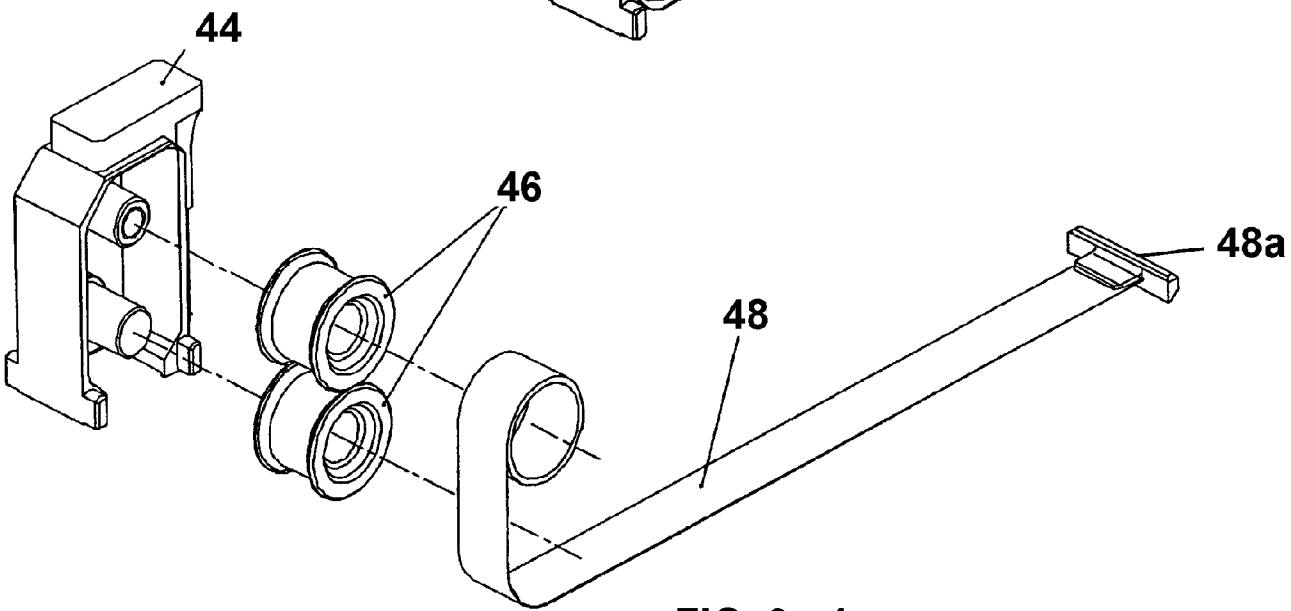

FIG. 3*d* is a perspective view with top half removed showing ten primers and FIG. 3*e* is an exploded view of the magazine assembly 28. FIG. 3*e*-1 is an exploded view and FIG. 3*e*-2 is a perspective view of the pusher assembly 43 contained in the magazine assembly 28. The magazine assembly 28 comprises end plate assembly 28*a*, clip 28*b*, top plate 28*c* and bottom plate 28*d*. A primer insertion opening 41 receives the primers 26. A pusher assembly 43 mounted between the top plate 28*c* and the bottom plate 28*d* properly biases and indexes the next available primer for firing. Pusher assembly 43 includes pusher 44, two spools 46 and a negator spring weldment 48. Hook 48*a* attaches to one end of the negator spring weldment 48. A finger assembly 49*a* provides proper alignment of a fresh primer during injection. A hand operable pull 47 interfaces with a slot in the top plate 28*c* for manual operation and proper alignment of the pusher assembly 43. Extraction opening 49 interfaces with the push pin 24*a* through tray assembly housing 32. A pair of retention guides 53 along the outer sides of the magazine assembly provide proper alignment and retention in the receiver area 45 of the tray assembly 21. In one embodiment of the magazine assembly, up to ten primers 26 can be stored in the magazine assembly 28.

Figure 3F:
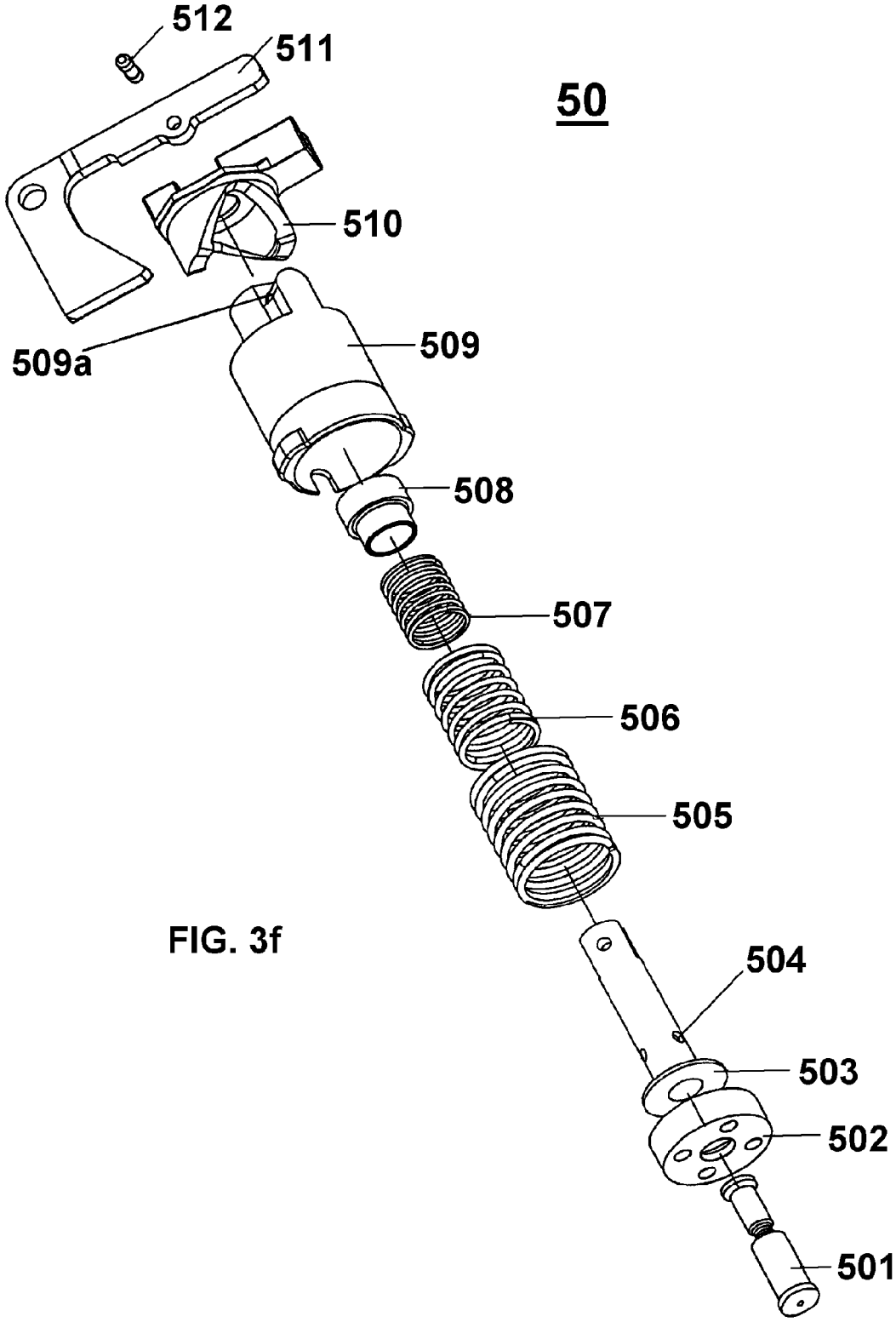
FIG. 3*f* is an exploded view of a firing mechanism assembly.
Figure 4:
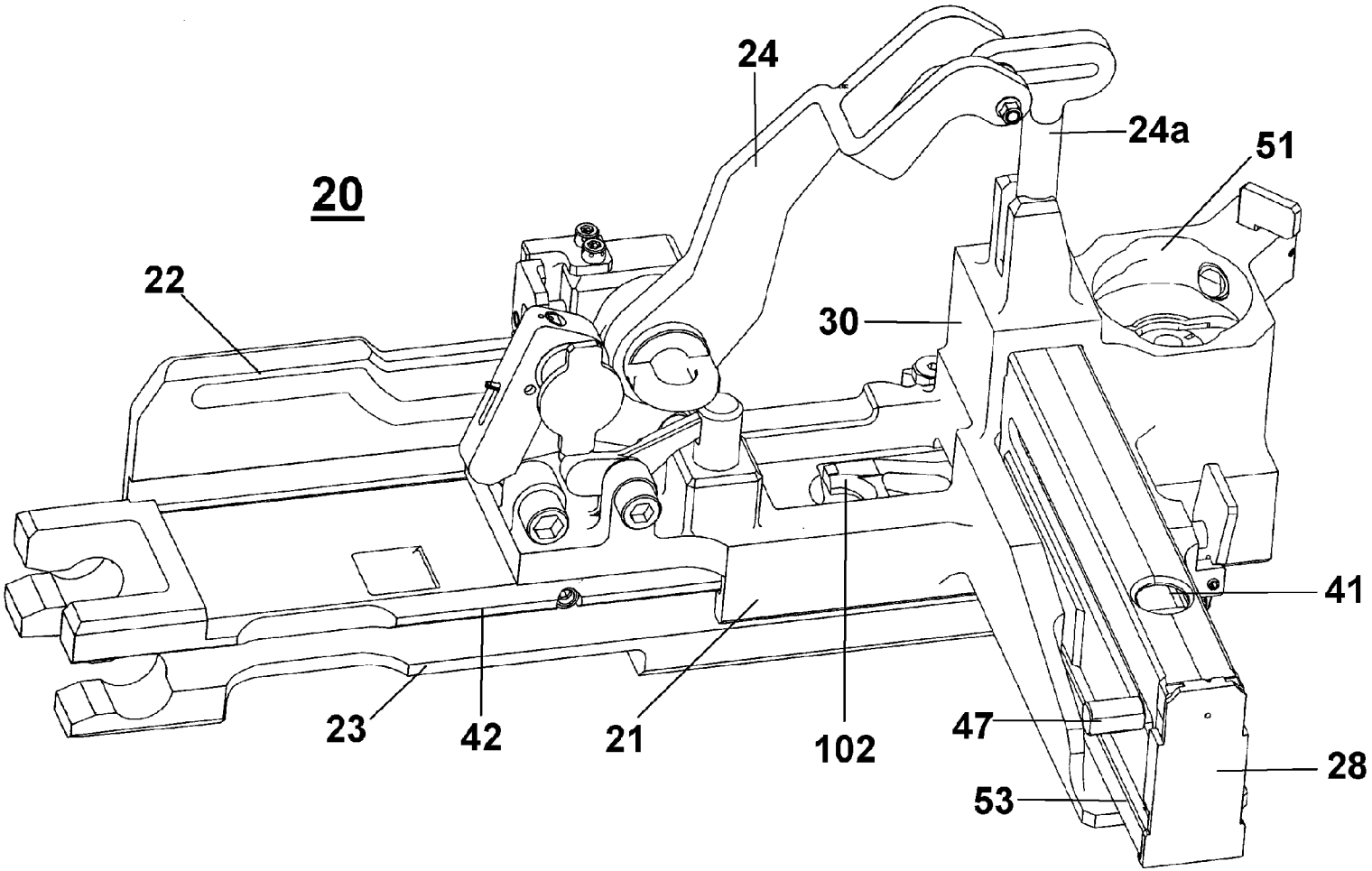
FIG. 4 is a perspective view of a portion of the primer feed mechanism showing the tray, body and magazine assemblies.

FIG. 3*f* is an exploded view of a firing mechanism assembly 50. The primer feed mechanism 20 can use various types of firing mechanism assemblies including, for example, a solenoid-type firing mechanism or a mechanical-type firing mechanism. The preferred firing mechanism assembly is shown in FIG. 3*f*. The firing mechanism assembly 50 includes: a hammer 501, a cup 502, a yoke 503, multiple ball bearings 504, multiple compressing springs 505, 506 and 507, a sleeve 508, a case 509 with a mating area 509*a* that cooperatively interfaces with a follower 510, a pin 512, and a lever 511. Because the mating area 509*a* of the upper portion of case 509 that mates with follower 510 has a greater interfacing surface area than previous designs, the firing mechanism assembly 50 provides improved reliability by minimizing jamming of the firing mechanism and misfiring.

When assembled, the firing mechanism assembly 50 is held together under compression by the pin 512 inserted through a hole in the lever 511. The hammer 501 is held in place within the yoke 503 by the ball bearings 504. In operation, the firing mechanism assembly 50 is actuated and ready to fire an artillery piece by pulling or twisting the lever 511. Direct pulling of lever 511 causes the hammer 501 to pull back. Twisting the lever 511 causes the mating area 509*a* between the case 509 and the follower 510 to rotate such that the follower 510 is distended outwards from the case 509 and the hammer 501 is pulled back. When the lever 511 is released, the follower 510 snaps back towards the case 509 which in turn releases the yoke 503 containing the hammer 501 with consequential detonation of a fresh primer cartridge 26 in the primer chamber 4.

OPERATION OF THE INVENTION

Operation of the primer feed mechanism 20 can be understood with reference to FIGS. 5-12. The operational phases of the mechanism include: a) firing of the artillery piece, b) recoil/counter-recoil of the artillery piece, c) ejection of the spent primer cartridge, d) opening the breech, e) loading ammunition into the artillery piece, f) closing the breech, g) loading a fresh primer into the primer chamber of the breech, and h) ready to fire the artillery piece again. As illustrated, the operation of the mechanism 20 can be referred to as a primer load cycle and a primer eject cycle. The breech is closed in FIGS. 5, 6, 7, 10, 11 and 12. The breech is opened in FIG. 8 and subsequently closed in FIG. 9 after loading ammunition. The arrows in FIGS. 5-12 adjacent to the injector arm assembly 24, quick release link 27 and actuator drive link 29 indicate operational dynamics of the mechanism.

Figure 5:
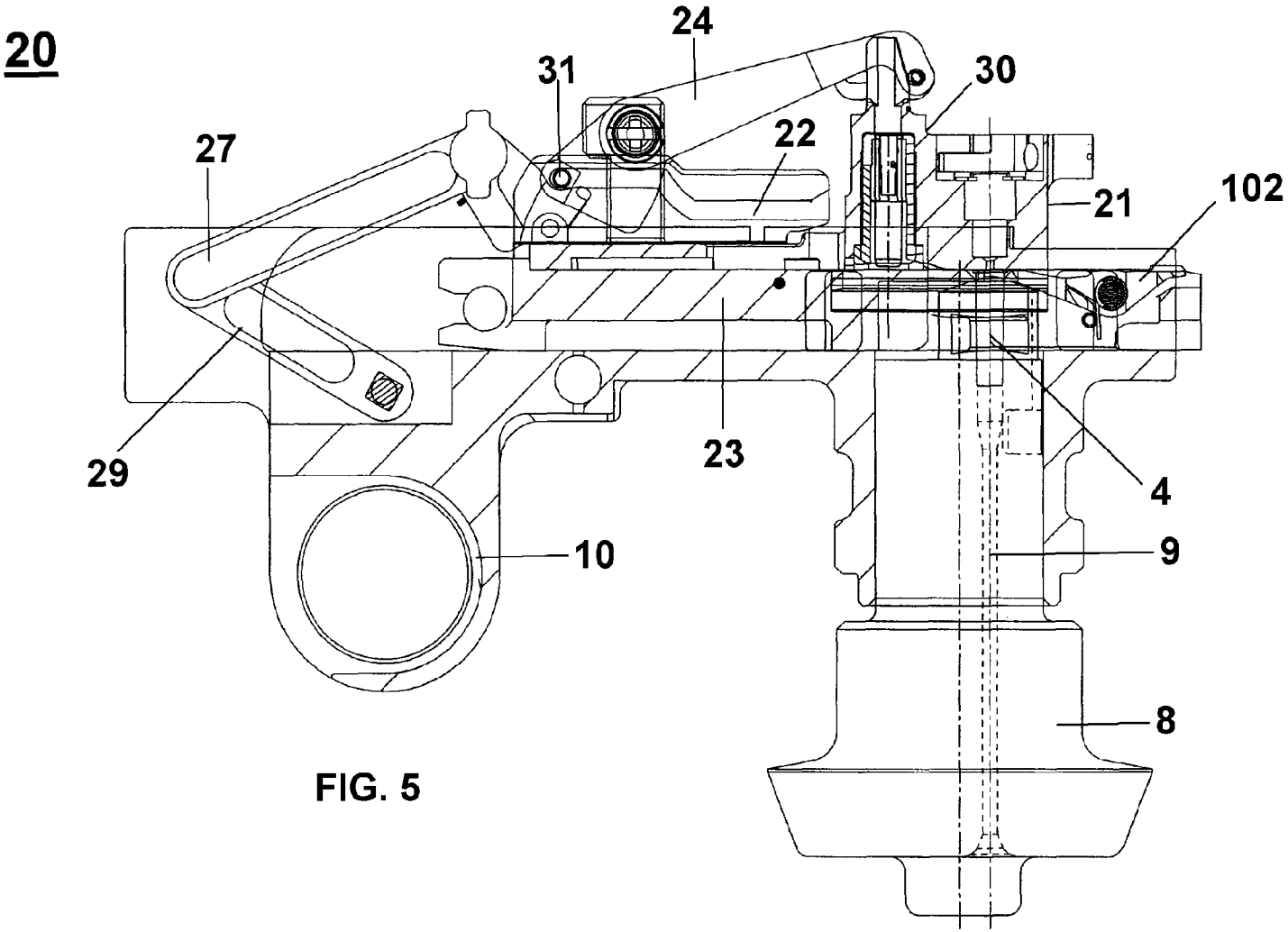
FIG. 5 is a side view of the primer feed mechanism in a ready to fire position and starting point of the extraction cycle.

FIG. 5 shows an initial condition just prior to firing of the artillery piece wherein the breech is closed and fresh ammunition is in the artillery piece. A fresh primer 26 is in the primer chamber 4. The tray assembly 21 is locked to body assembly 23 by insertion of the locking plunger 15 (FIG. 3*a*-1) of the tray assembly 21 in the locking plunger pocket 14 (FIG. 3*c*) of the body assembly 23. The tray assembly 21 is locked in a position with the firing mechanism assembly 50 over the primer chamber 4 with the fresh primer 26 within. The injector arm assembly 24 is down and inside the magazine assembly 28. The artillery piece's system power actuator (not shown) is engaged with the externally mounted actuator (not shown) of the primer feed mechanism 20.

The artillery piece is fired by actuation of the firing mechanism assembly 50 which causes the primer to detonate which ignites the main propellant charge. After firing, recoil motion of the artillery piece disengages the system power actuator from the externally mounted actuator of the primer feed mechanism 20. The tray assembly 21 remains locked to the body assembly 23 through the locking plunger 15. Then, on counter-recoil of the artillery piece, the system power actuator re-engages the externally mounted actuator for the primer feed mechanism 20. The tray assembly 21 remains locked to the body assembly 23 through the locking plunger 15.

Figure 6:
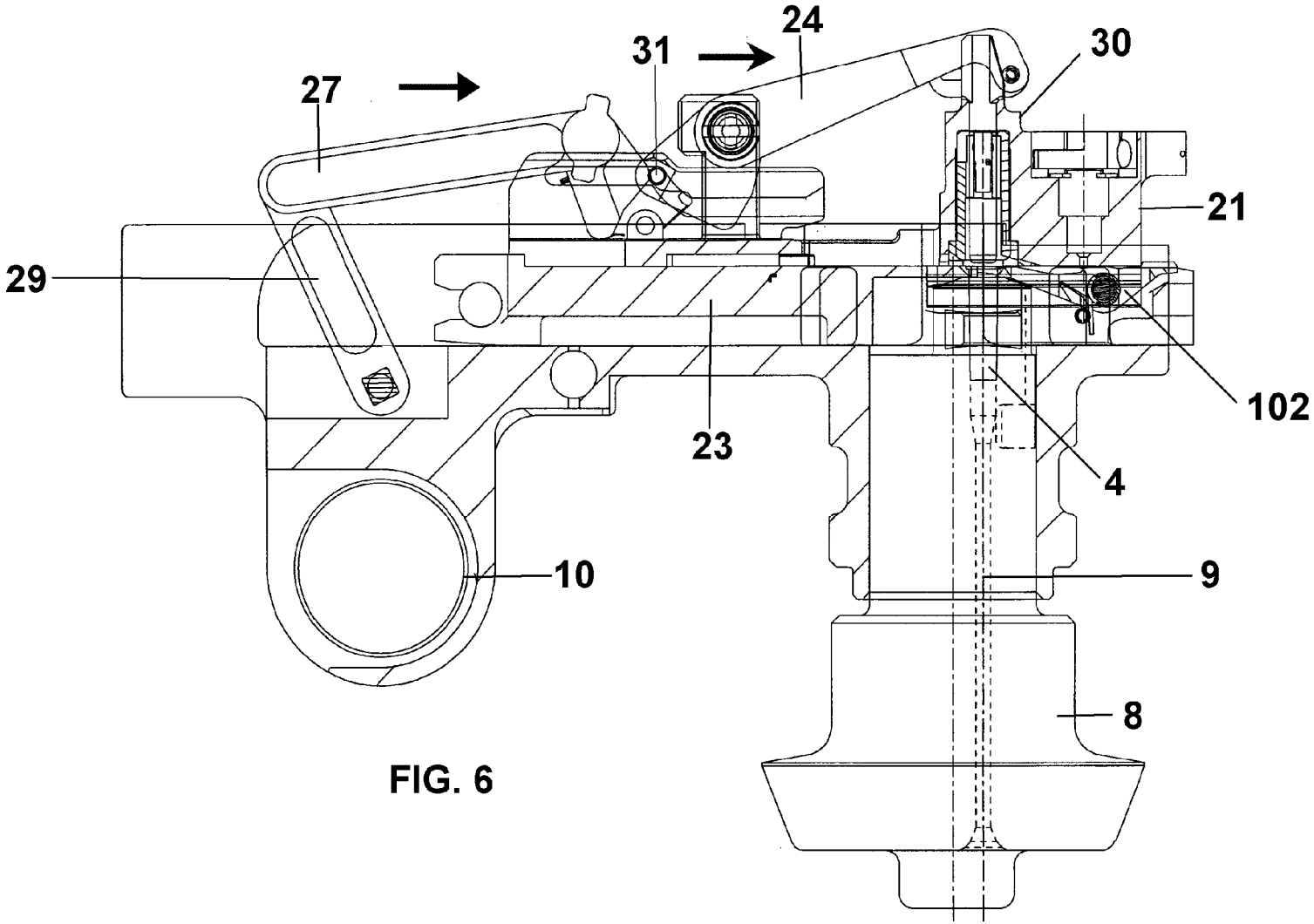
FIG. 6 is a side view of the primer feed mechanism in the extraction cycle.

Next, as shown in FIG. 6, initiation of the primer eject cycle begins with the breech still closed. The system power actuator applies load to the primer feed mechanism 20 through the actuator drive link 29, the quick release link 27, the drive link assembly 25 and through the follower 31 that connects to injector arm assembly 24 to unlock the locking plunger 15 and allow the tray 21 to move. Continued application of load to the injector arm assembly 24 communicates linear motion to the tray assembly 21 through the follower 31 and follower plate 22.

Figure 7:
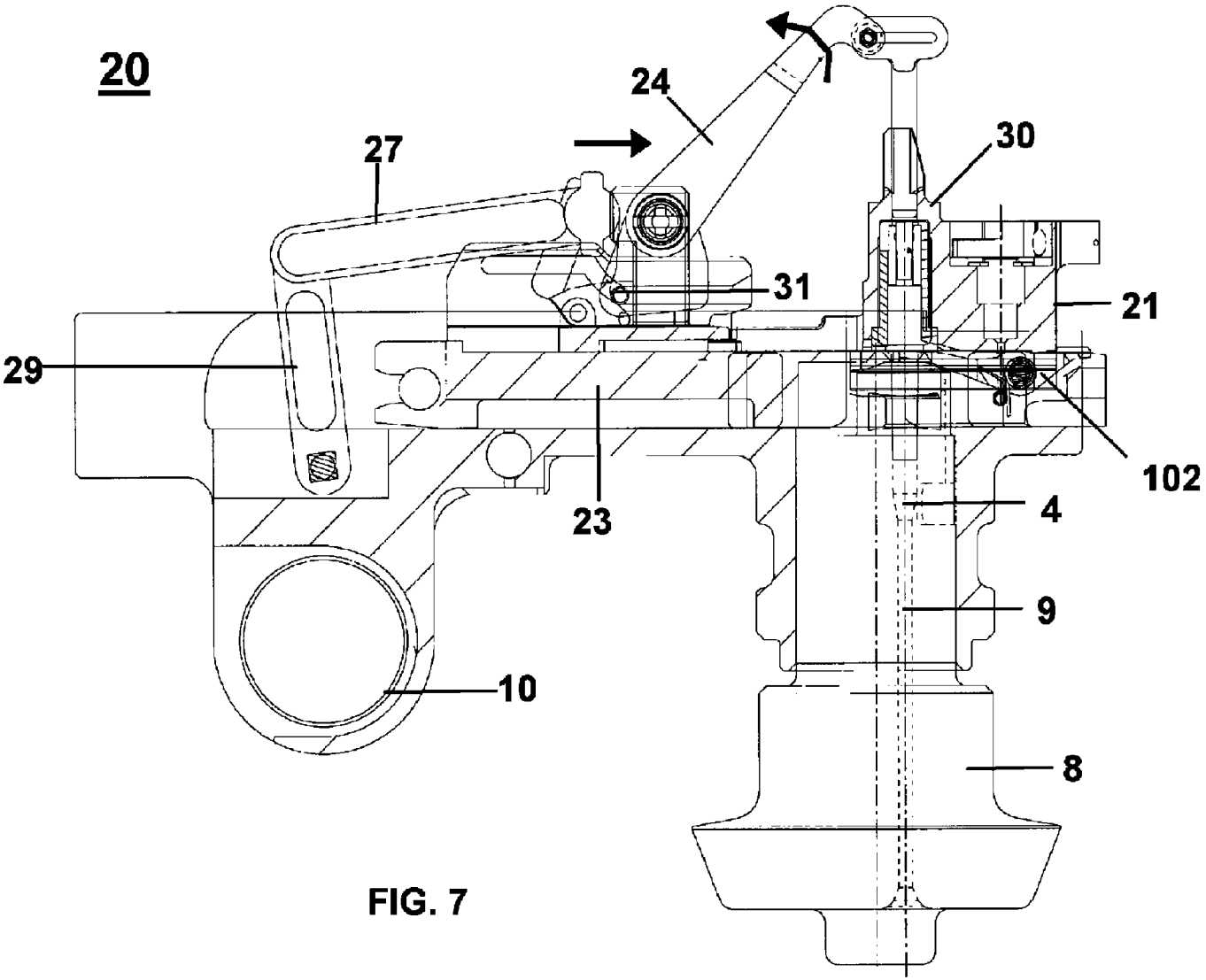
FIG. 7 is a side view of the primer feed mechanism in the extraction cycle with the injector arm assembly raised and the breech closed.

Next, as shown in FIG. 7, with the breech still closed, the primer eject cycle continues where continued loading of the injector arm assembly 24 occurs causing it to rotate and rise out of the magazine assembly 28 while linear translation of the tray assembly 21 dwells. The next fresh primer 26 is indexed in the magazine assembly 28. Continued loading of the injector arm assembly 24 causes the tray assembly 21 to then resume linear translation towards a full extract position of travel within the body assembly 23.

Figure 8:
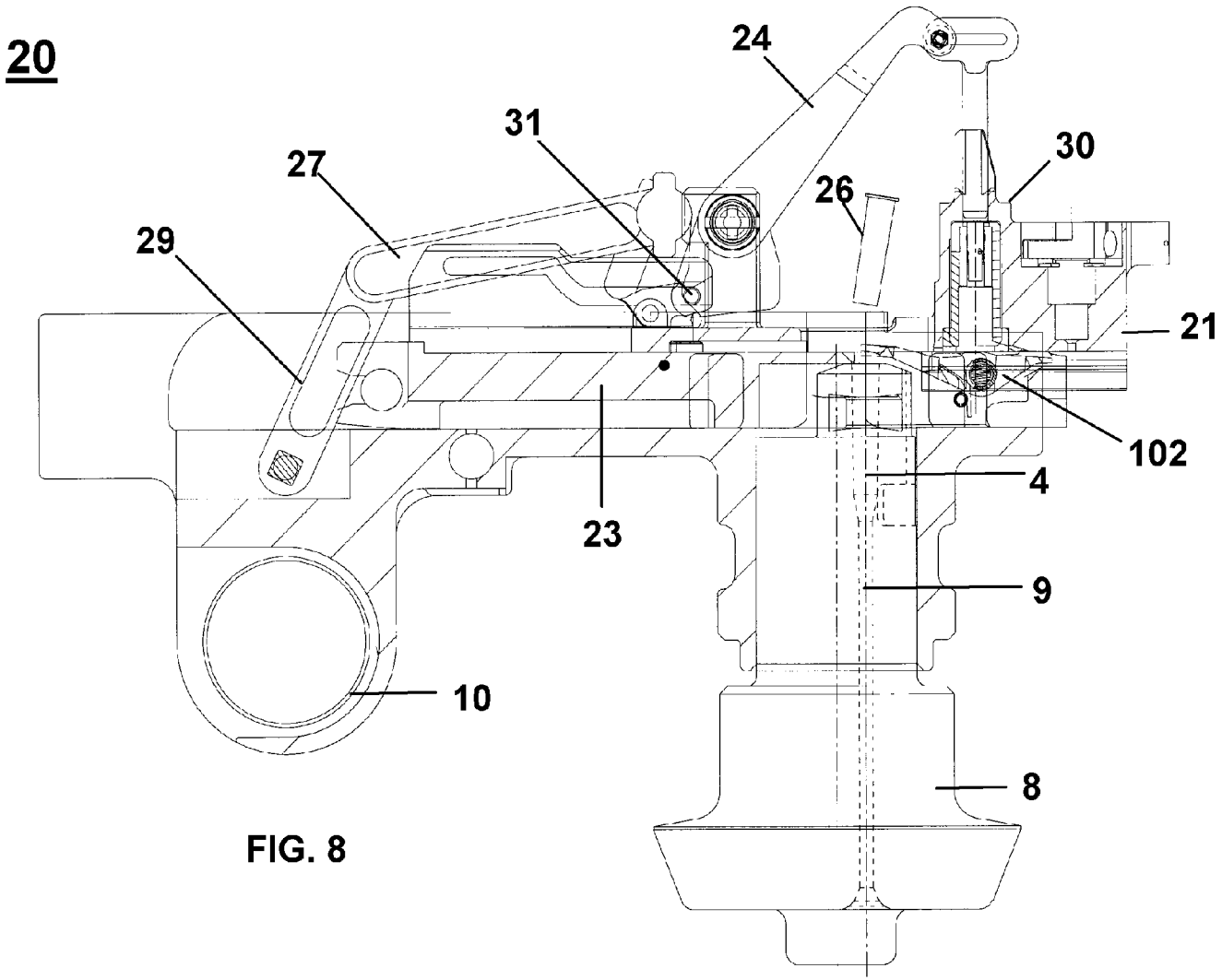
FIG. 8 is a side view of the primer feed mechanism in the extraction cycle with a fired primer being extracted.
Figure 9:
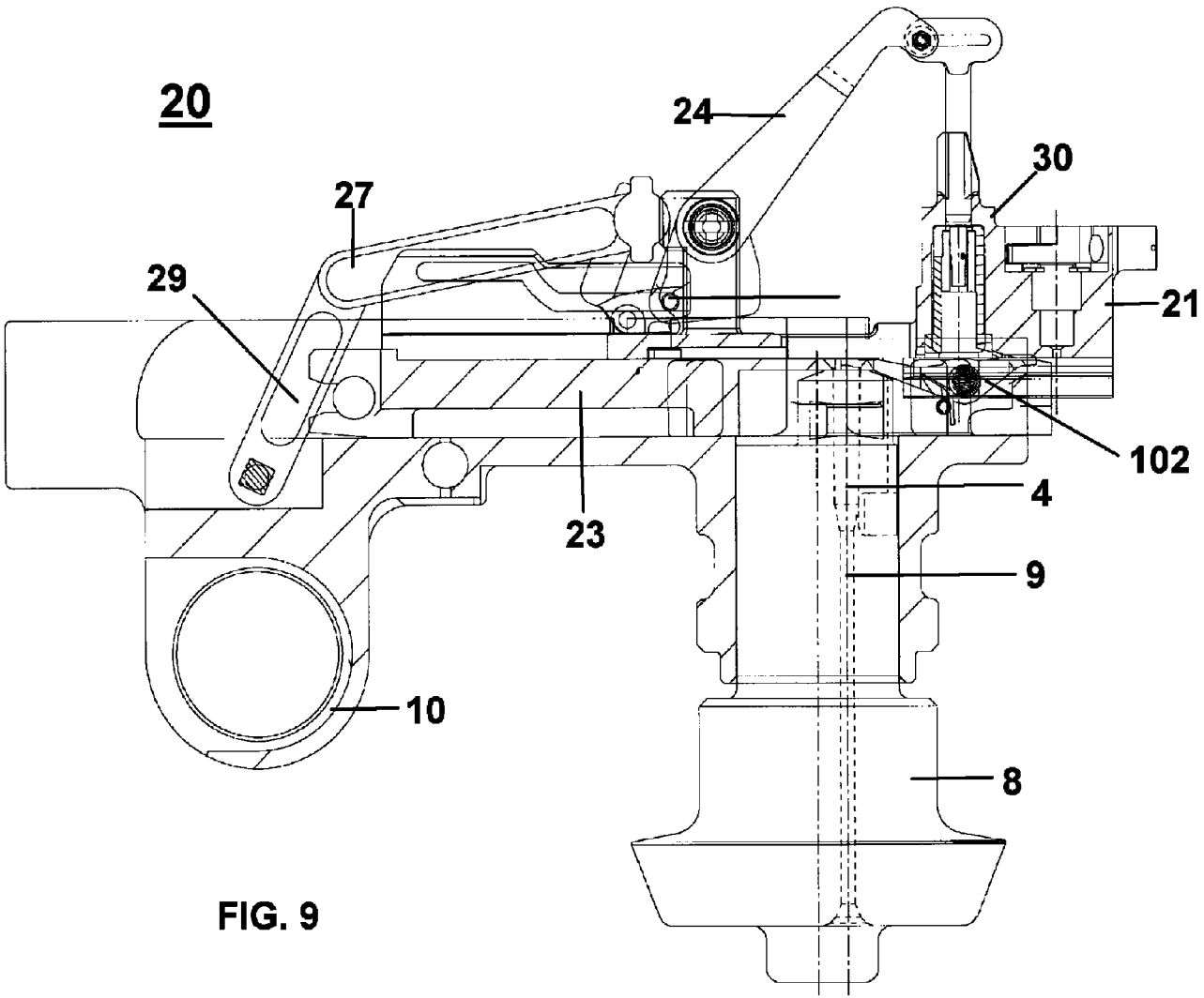
FIG. 9 is a side view of the primer feed mechanism at initiation of the primer loading cycle.

In FIG. 8 the spend primer 26 is extracted as the extract member 12 (FIG. 3*a*-3) of the tray assembly 21 actuates the primer extract 102 in the body assembly 23 by rotating the primer extractor 102. The tray assembly 21 is then in a full extract position. The breech can be opened and fresh ammunition can be loaded into the artillery piece. Opening of the breech engages a safety latch assembly 16 (FIG. 2) that latches the tray assembly 21 in a full extract position as shown in FIG. 9. In this condition, the tray assembly 21 cannot be accidentally moved to load a fresh primer when the breech is open. A fresh projectile and propellant charge can then be loaded into the artillery piece and the breech closed. After complete closure of the breech, the safety latch assembly 16 is then released and the primer load cycle begins where the load can again be applied to the injector arm assembly 24.

Figure 10:
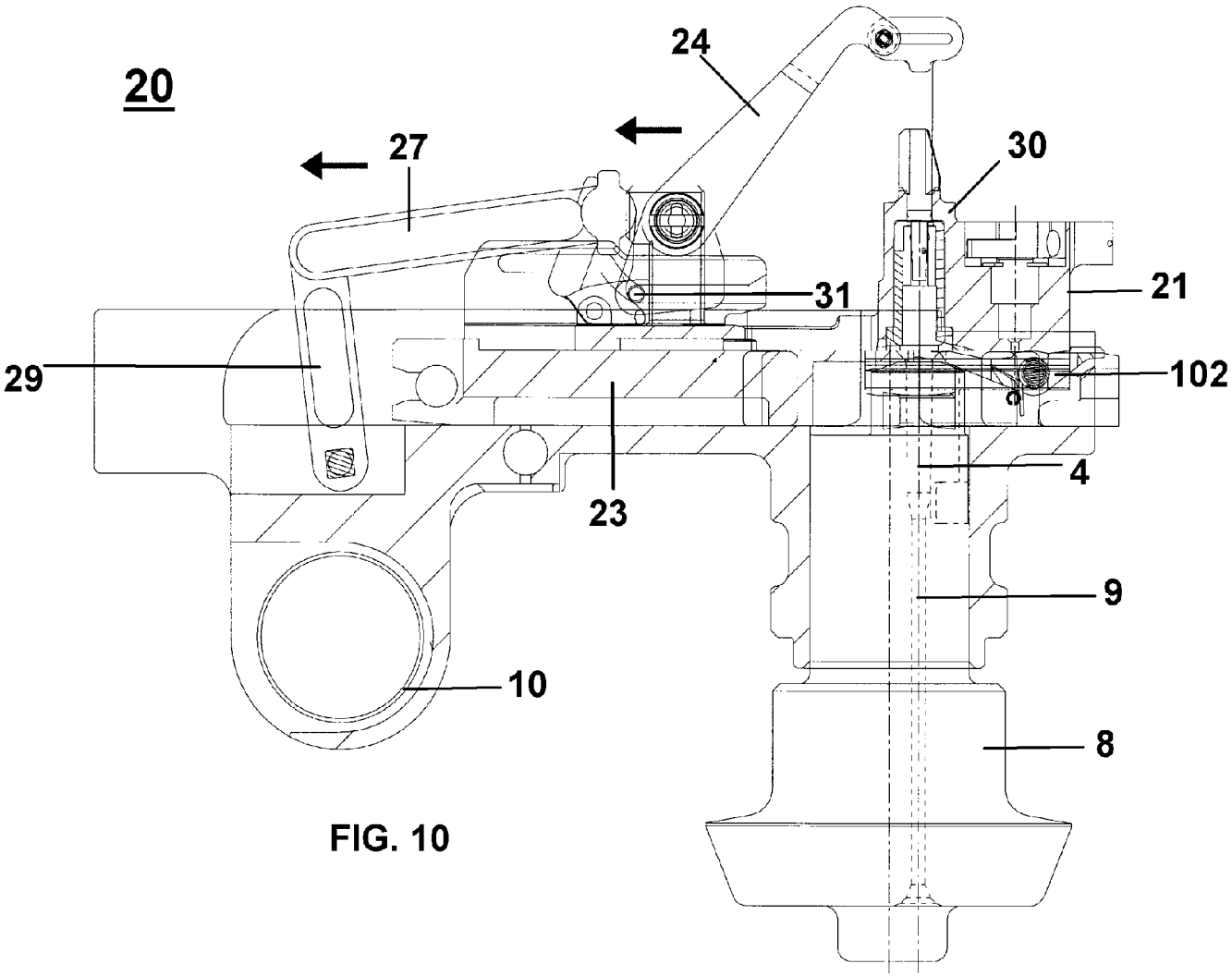
FIG. 10 is a side view of the primer feed mechanism in the primer loading cycle.
Figure 11:
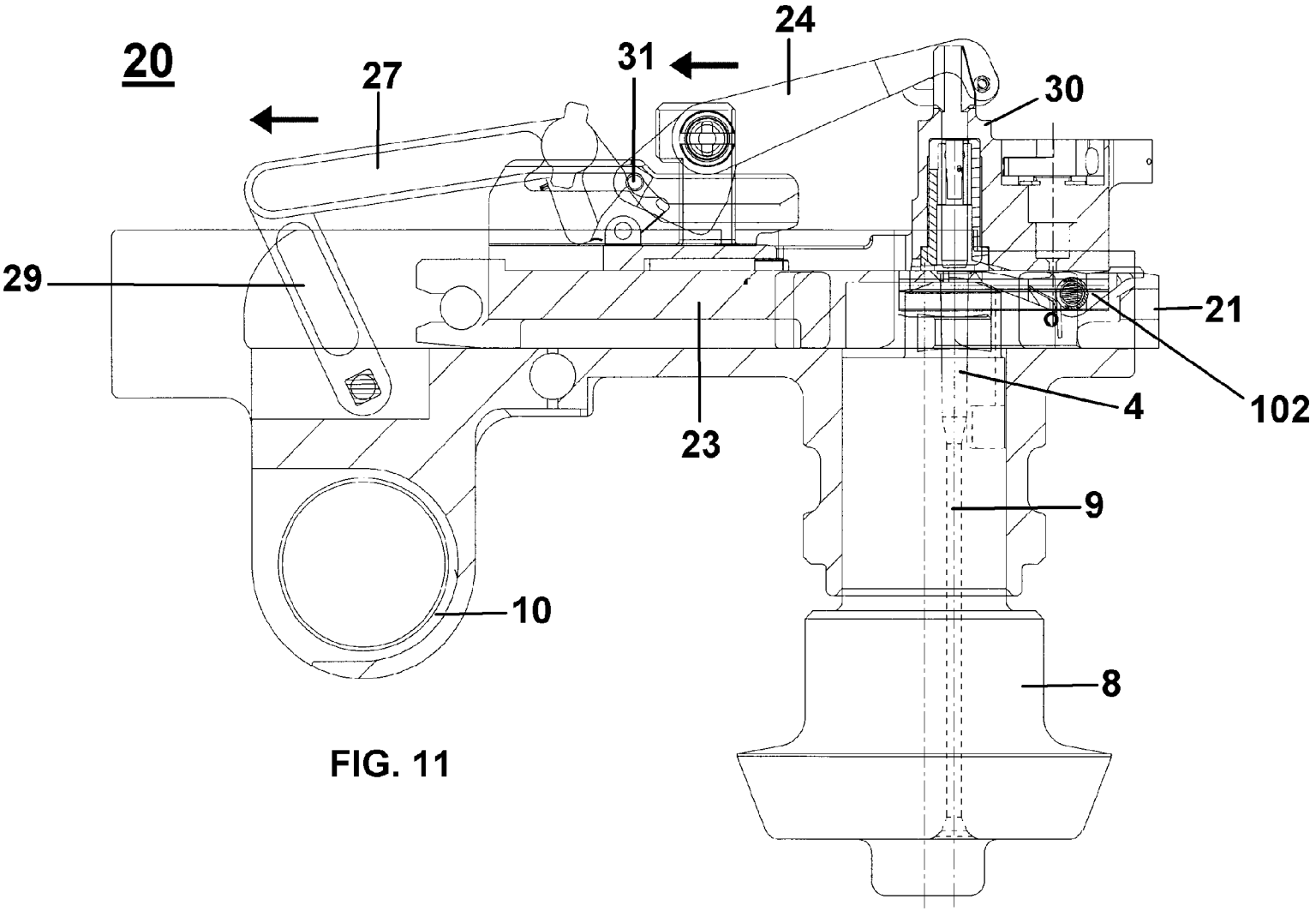
FIG. 11 is a side view of the primer feed mechanism in the primer loading cycle where the injector arm assembly rotates to inject the primer.

The beginning of the primer load cycle in shown in FIG. 10. A fresh primer 26 is indexed to be in-line with the extraction opening 49 of the magazine assembly 28. As the motion of the tray assembly 21 dwells, the injector arm assembly 24 rotates by the interactions of the follower 31 (FIG. 3*a*) and the follower plate 22 causing injection of a fresh primer into the primer chamber 4. In FIG. 11, the linear motion of the tray assembly 21 resumes with the injector arm assembly 24 and push pin 24*a* injecting the primer 26 into the primer chamber 4 by downward motion of the push pin 24*a* within the tray housing 32.

Figure 12:
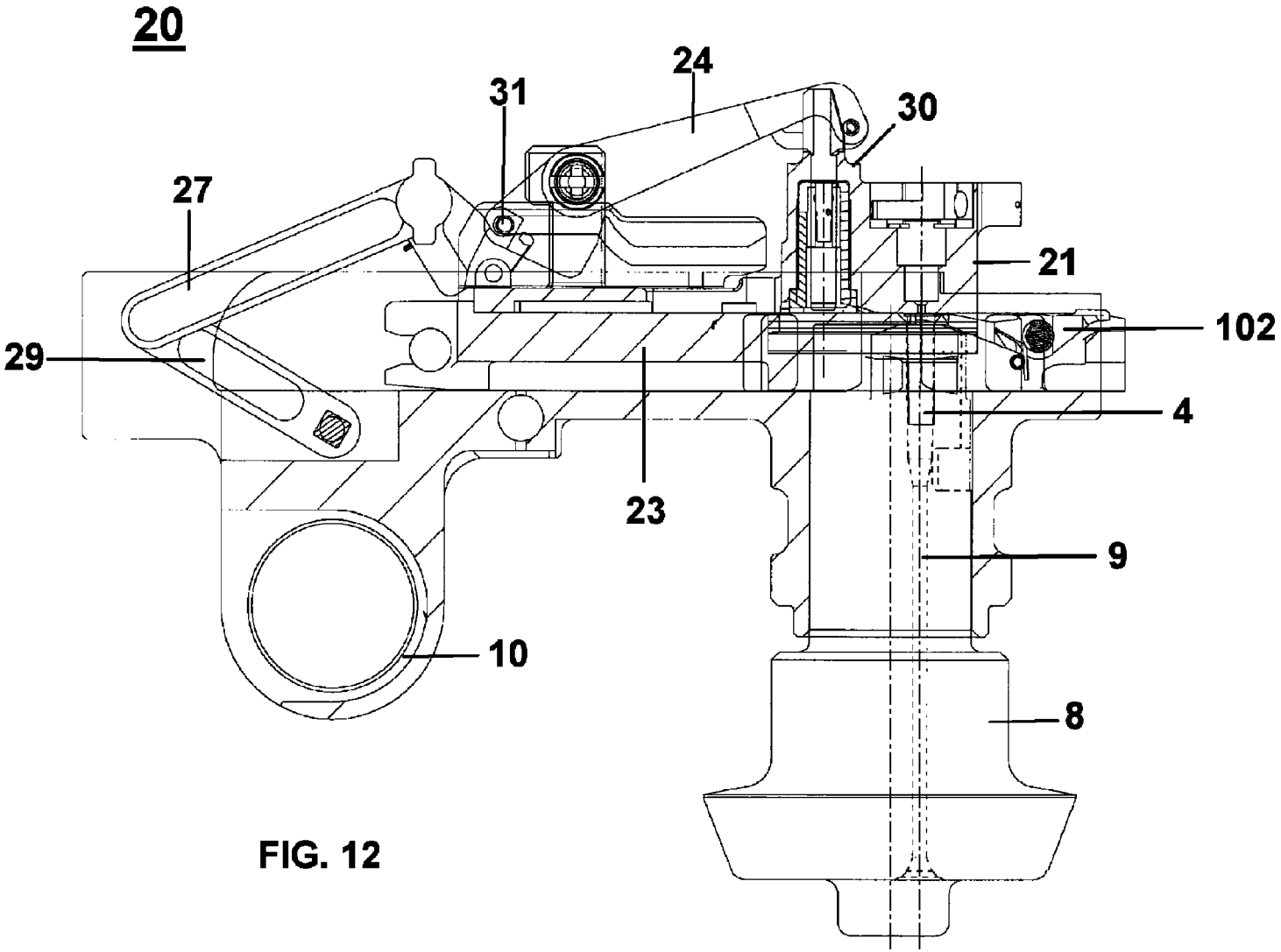
FIG. 12 is a side view of the primer feed mechanism with the primer loaded and in a fire position.

In FIG. 12, the tray assembly 21 translational motion continues to the end of travel with the firing mechanism assembly 50 positioned over the fresh primer. The pushpin 24*a* is positioned in the magazine assembly 28 through the extraction opening 49. Termination of tray assembly motion causes the locking plunger 15 to re-engage, locking the tray assembly 21 to the body assembly 23 in a fire position. The primer feed mechanism 20 is in firing position again as in FIG. 5 and the artillery piece is ready to fire again.

While particular embodiments of the present invention have been illustrated and described, it is not intended that these illustrations and descriptions limit the invention. Changes and modifications may be made without departing from the scope and spirit of the invention. For example, the primer feed mechanism can be readily adapted for use with a variety of existing artillery pieces. Moreover, the invention can be used in non-military applications where a machine requires an automatic injection mechanism.

What is claimed is:

1. In a primer feed mechanism mounted on a carrier of an artillery piece, the primer feed mechanism having a body assembly having guide rails and a follower plate, a tray assembly moveable on the guide rails of the body assembly, the tray assembly including a housing and an injector arm assembly, an actuator drive link connected to the carrier, a quick release link connected to the actuator drive link, a drive link assembly connected to the quick release link and to the injector arm assembly, one end of the injector arm assembly includes a push pin assembly including a push pin that reciprocates in the housing to inject a primer and having a follower at the other end of the injector arm assembly, the follower traveling in a follower plate of the body assembly wherein the tray assembly further comprises a magazine assembly, the magazine assembly; comprising:

top and bottom plates assemblies;

a primer insertion opening formed in the top and bottom plates assemblies; the plates assemblies having associated with the primer insertion opening internally facing linear grooves for restricting primer movement in line one after another in single file instead of side by side or nested stacking while maintaining primer cartridge orientation laterally to the orientation of the plates assemblies throughout primer movement;

a pusher assembly disposed between the top and bottom plate assemblies for biasing and indexing primers and in coordination with the injector arm assembly; and a primer extraction opening formed in the top and bottom plate assemblies.

2. The magazine assembly of claim 1 further comprising a finger assembly disposed between the top and bottom plate assemblies and adjacent the primer extraction opening, for aligning primers during extraction from the magazine assembly.

3. The magazine assembly of claim 1 further comprising an end plate assembly attached to one end of the top and bottom plate assemblies and a clip attached to another end of the top and bottom plates.

4. The magazine assembly of claim 1 wherein the pusher assembly comprises a pusher, two spools mounted in the pusher and a negator spring weldment wound around the two spools.

* * * * *